US005788817A

United States Patent [19]

Bentele et al.

[11] Patent Number: 5,788,817

[45] Date of Patent: Aug. 4, 1998

[54] THREE ROLL PRESS

[75] Inventors: Rainer Bentele, Friedrichschafen; Christian Schiel, Heidenheim; Wolf Gunter Stotz, Ravensburg, all of Germany

[73] Assignee: Voith Sulzer Papiermaschinen GmbH, Germany

[21] Appl. No.: 878,725

[22] Filed: Jun. 19, 1997

Related U.S. Application Data

[62] Division of Ser. No. 658,853, May 31, 1996.

[30] Foreign Application Priority Data

Jun. 3, 1995 [DE] Germany ..... 195 20 443.3

[51] Int. Cl.[6] ..... D21F 3/02

[52] U.S. Cl. ..... 162/360.3; 100/153; 162/358.3

[58] Field of Search ..... 162/358.3, 358.5, 162/360.3; 100/153, 155 R, 176, 154

[56] References Cited

U.S. PATENT DOCUMENTS 4,556,454 12/1985 Dahl et al. ..... 162/358.3
5,404,811 4/1995 Schiel et al. ..... 162/273

FOREIGN PATENT DOCUMENTS 372178 6/1990 European Pat. Off. .
2155477 10/1973 Germany .
2909277 9/1980 Germany .

*Primary Examiner*—K. M. Hastings
*Attorney, Agent, or Firm*—Ostrolenk, Faber, Gerb & Soffen, LLP

[57] ABSTRACT

The invention relates to a roll press including at least three rolls forming several press nips for the treatment of a web of material. One press roll comprises a very flexible roll shell which is rotatable around a fixed support and is mounted on the support by at least one support element which has a concave support surface for defining a wide press nip with a cylindrical backing roll. The backing roll forms an additional press nip with at least one not sag-controlled roll. To obtain as uniform as possible a press nip between the backing roll and at least one additional roll which is without sag control, the circumference of the roll shell of the backing roll decreases axially towards its ends, i.e., that roll may be crowned. In addition, the backing roll may have its own roll shell support elements which are either in the press plane or are inclined slightly out of the press plane and/or the hydraulic pressure fluid supplied to the press roll and to the backing roll is adapted to supply a greater pressing force by the press roll. Optionally, a fourth press roll may form a nip with the additional roll. A felt passes through each nip.

9 Claims, 2 Drawing Sheets

FIG. 1A
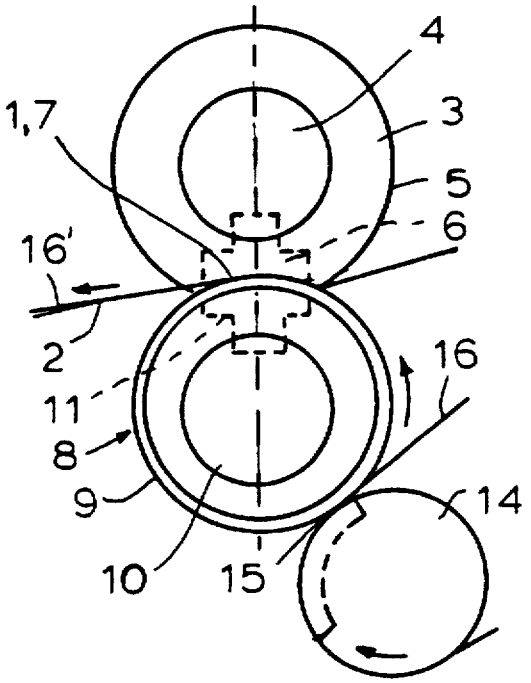
FIG. 1
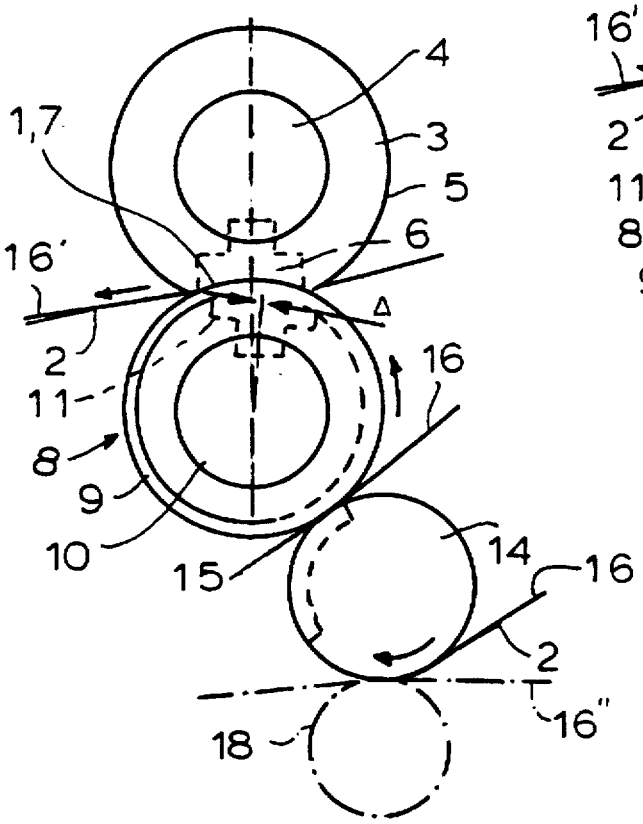
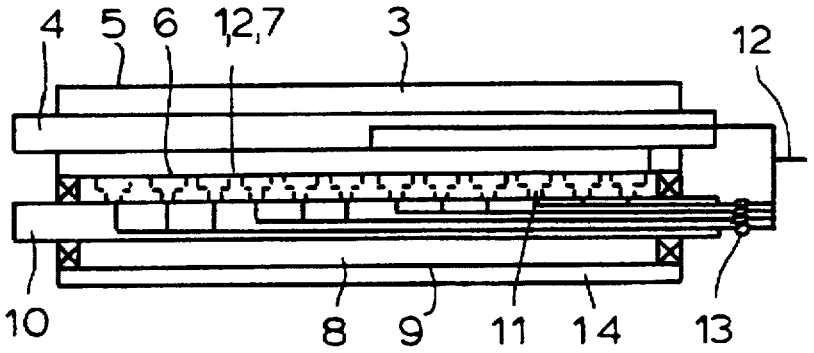
FIG. 2

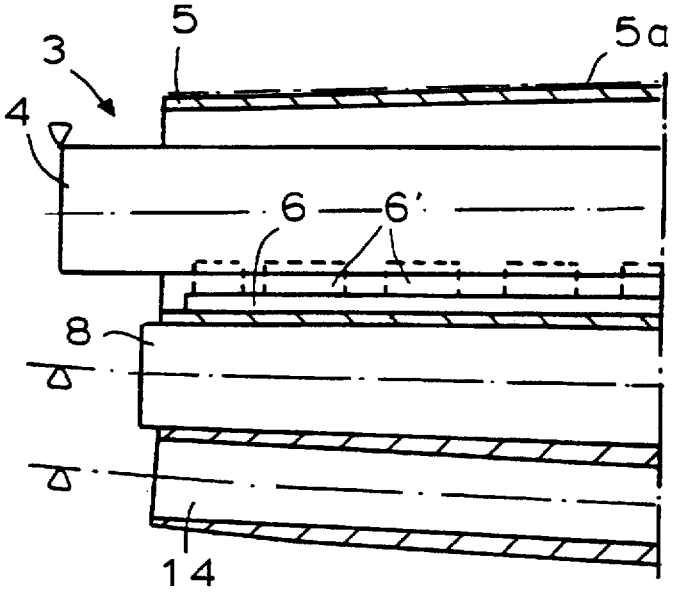
FIG. 3
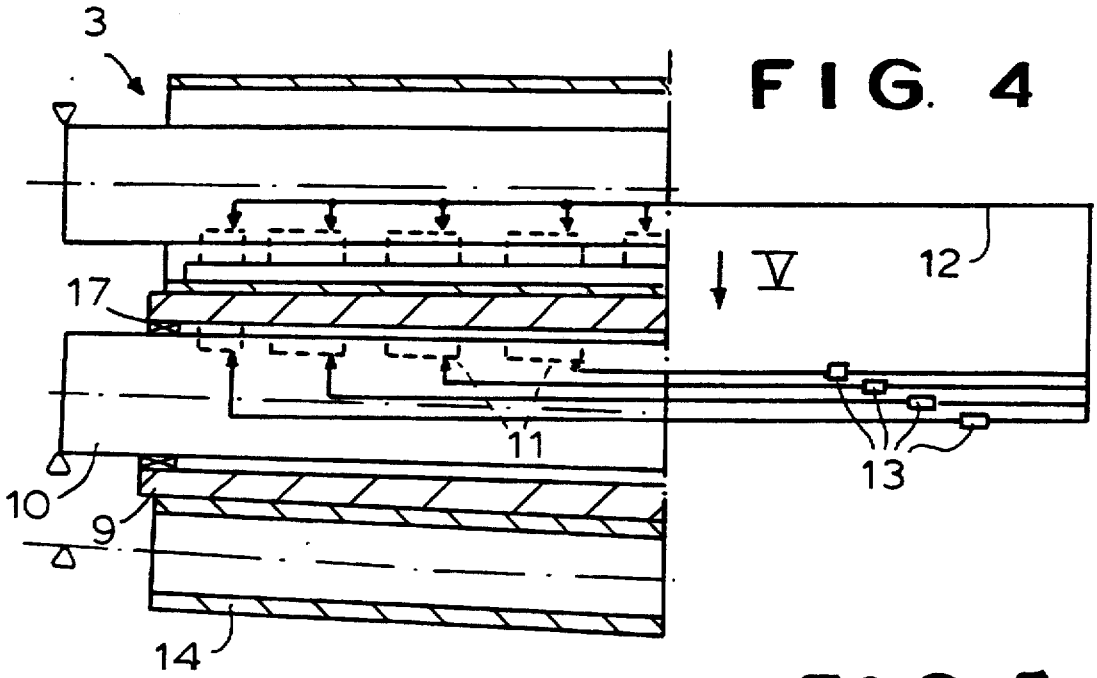
FIG. 4
FIG. 5
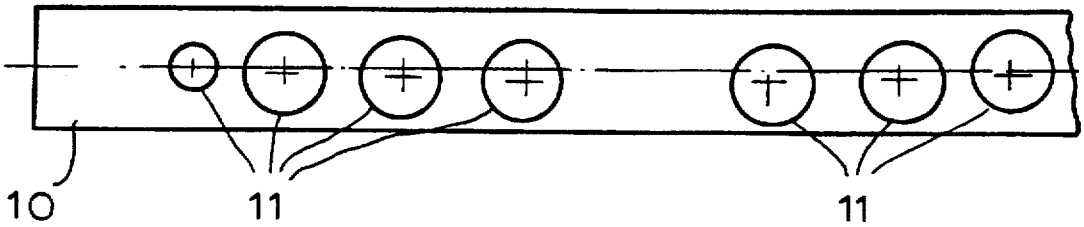

THREE ROLL PRESS

This is a Division of application Ser. No. 08/658.853, filed May 31, 1996.

BACKGROUND OF THE INVENTION

The present invention relates to a roll press including at least three rolls which form several press nips such as may be used, for instance, for dewatering or smoothing a fiber web, like a paper web. The invention particularly concerns profiling of the rolls and application of the roll shell supports for optimizing application of pressure in the nips.

The roll press with which the invention is used typically includes a shoe press type roll having a stationary support, a flexible roll shell which rotates around the support and a concave shoe or shoes along the support. The shoe press roll cooperates with a backing roll to define a press nip between the flexible roll shell and the backing roll at the concave shoe. The backing roll may sag between its end supports due to its weight and to the pressure applied to it by the press roll.

A third roll may cooperate with the backing roll to counter the sag. If the backing roll cooperates with a third roll which is not sag controlled, as shown in WO 93/12289, which corresponds to U.S. Pat. No. 5,404,811, difficulties can occur, due to roll sag, in the formation of a uniform press nip which is to be as straight as possible.

Although it is possible to provide the backing roll or the third roll with support elements in the press plane for controlling the sag of the shells of those rolls, this requires considerable expense. Furthermore, considerable thermal problems can be produced in the customary hydraulic support elements if the backing roll and/or the third roll are heated so as to improve the web dewatering or smoothing.

SUMMARY OF THE INVENTION

It is the object of the present invention to provide a roll press which makes it possible to achieve as uniform as possible a press nip between the backing roll and at least one additional roll, even without sag control.

The roll press of the invention includes at least three rolls forming several press nips for the treatment of a web of material. An alternative includes a fourth press roll forming yet another press nip.

There is a press roll comprising a very flexible roll shell which is rotatable around a fixed support and which is mounted via at least one support element on the support. That support element has a concave support surface defining a wide or extended press nip between the press roll shell and a cylindrical backing roll. The backing roll forms an additional press nip at least with one further third roll which is not sag controlled.

According to the invention, the backing roll, which backs against the press roll in turn forms an additional press nip with a third roll that is not sag controlled. The roll shell of the backing roll has an outer circumference that decreases from the axial center of the backing roll axially toward the ends of that roll and this roll is therefore crowned.

There may be a fourth press roll which forms a third press nip with the third, not sag controlled roll.

In addition, the circumference of the roll shell of one or of both of the press roll and the third roll also may decrease starting from the axial center and axially toward the ends of the respective roll and this roll is therefore crowned.

To make it possible to achieve as uniform as possible a press nip not only between the press roll and the backing roll but also between the backing roll and the at least one additional, not sag controlled roll, the invention provides three independent, mutually exclusive solutions, which can also be employed in combinations with each other. They all have in common that the roll shell of the backing roll is axially increasingly bent in the central region toward the additional roll. The outer circumference of the roll shell of the backing roll may decrease in the axial direction of the roll, starting from the center of the roll axially outward toward the ends of the roll, i.e., it is crowned, and/or the backing roll may also be comprised of a roll shell which is rotatable around a fixed support and which is mounted on the support by at least one support element.

In the latter case, if the additional roll is not arranged precisely opposite the press roll whereby the two press nips are not in one plane of pressure applied by the press roll, then deformation of the roll shell of the backing roll can be achieved by slight inclination of the direction of action of the support element of the backing roll by a rotation angle $\Delta$ out of the press plane formed with the press roll and toward the roll which forms an additional press nip with the backing roll. The usual fixing of the positions of the ends of the shell of the backing roll relative to its stationary support may merely permit displacement of the roll shell within the press plane with the press roll. Therefore, the inclination of the support elements produces increased deformation of the roll shell of the backing roll radially toward the additional roll in the axially central region of the backing roll. In this connection, there can also be several rolls arranged on this side of the press plane.

Independently of whether the support element of the backing roll acts precisely in the direction toward the press roll or is inclined out of the press plane that is formed with the press roll, if the additional roll or rolls act in the semi-circular area (as seen in the cross section of the roll) of the backing roll which lies opposite the press nip between the backing roll and the press roll, it is possible to achieve increased sagging of the backing roll toward the additional roll in the axially central region of the backing roll through the oppositely located support elements of both the press roll and the backing roll being connected individually, in groups or in their entirety, to a common fluid pressure line. Using devices which reduce the fluid pressure and/or selecting the relative sizes of the support surfaces of the oppositely located support elements produces a greater pressing force of the press roll as compared with the pressing force of the support elements coming from the backing roll. This occurs because the shell of the backing roll is mounted at its ends radially non-displaceably with reference to the support.

Particularly where the outer circumference of the shell of the backing roll decreases from the center of the roll axially toward the ends of the roll, i.e., it is crowned, it is advantageous if the circumference of the shell of the press roll and/or of the roll forming another press nip with the backing roll also decreases, i.e., it is crowned, preferably to the same extent, starting from the axial center of the roll axially toward the ends of the roll. This makes it possible to decrease the extent of the circumferential decrease of each roll to a minimum so that the differences in speed between contacting roll surfaces decrease. Such differences in speed may occur at certain areas of the press nip. Furthermore, differences in speed on the roll surface between corresponding rolls are minimized or excluded.

If the direction of action of the support element is inclined out of the press plane, the angle of inclination $\Delta$ should be between 2 and 15, and preferably between 4° and 8°. To increase the deformation of the shell of the backing roll in the axially central region, i.e. in the region of the center of the machine, it is further advantageous for the angle of inclination to change, starting from the center of the roll, in the axial direction toward the ends of the roll, and particularly for the angle to show a declining trend.

As in most roll presses used for dewatering in a paper making machine, at least one dewatering felt passes through each nip of the press with the web supported on a surface of the felt.

Other objects and features of the invention are explained below.

BRIEF DESCRIPTION OF THE DRAWINGS

FIG. 1 is a diagrammatic cross section through a roll press having at least three rolls, with the rolls and their roll shell support elements in a first arrangement;

FIG. 1A is a diagrammatic cross section through a roll press having three rolls, with the rolls and their roll shell support elements in a second arrangement;

FIG. 2 is a diagrammatic longitudinal section through the roll press and showing the fluid control;

FIG. 3 is a diagrammatic, longitudinal section of the roll press;

FIG. 4 is a similar longitudinal section of an alternate embodiment; and

FIG. 5 is a top view of the stationary support of the backing roll in FIG. 4 showing an arrangement of support elements.

DESCRIPTION OF A PREFERRED EMBODIMENT OF THE INVENTION

The illustrated roll press of the invention shown in FIG. 1 comprises at least three rolls which are arranged approximately one above the other. The rolls are mounted in a frame (not shown) and together form two press nips 1 and 15 for treating a web of material 2, preferably a paper or board web. The press roll 3 is located preferably above the backing roll 8, and they are in an approximately vertical press plane. The third roll 14, which is developed as a suction roll, is staggered with respect to or out of the press plane and is below the backing roll 8. An optional fourth bottom press roll 18 is disposed directly below and defines a nip with the third roll 14.

To make this roll press suitable particularly for dewatering a fiber web, several dewatering felts 16 for absorbing water pressed out of the web travel through the press nips 1 and 15 and the optional nip between rolls 14 and 18 along wits the web of material 2. In particular, and in the sequence in which the web passes through the roll press in FIG. 1, as shown by the arrows indicating travel direction, the web enters the press carried on the bottom outside surface of the bottom run of the press felt 16. Where the fourth bottom roll 18 is provided, a lower felt 16" passes through the nip between the rolls 14 and 18 so that the web is sandwiched between the felts 16 and 16". With the aid of the suction box in roll 14, the web rides around the roll 14 being held to the outside of the felt 16, and the felt 16 carries the web through the nip 15 between the backing roll 8 and the third roll 14. The web then lifts off the felt 16 and travels around the shell 9 of the backing roll 8 toward the nip 1. An upper felt 16' passes through the nip 1 and it meets the web before that nip and carries the web on the underside of the felt 16 through that nip. The felt 16 moves out of the press to the left in FIG. 1 carrying the web to the next station of the machine. Felts are conventionally supported in a roll press to be guided under appropriate tension through nips and around rolls as discussed above. All of the felts 16, 16' and 16" would be endless loops and only their sections at the press are illustrated.

The press roll 3 is comprised of a very flexible roll shell 5 which is rotatable around a fixed support 4 and which is mounted on the support 4 via a hydraulic support element 6 which is in the form of an axially extending strip. The support element 6 comprises an axially extending strip or shoe which is supported by a plurality of support elements 6'. This shoe has a concave support surface 7. Instead of a strip which is mounted on a hydraulic pressure cushion, it is also possible to employ several hydraulically supported support elements 6 arranged axially along the support 4. These are examples of known shoe press construction. Lubrication of the slot between the support surface 7 and the inner surface of the roll shell 5 can take place hydrostatically and/or hydrodynamically.

The concave support surface 7 forms a relatively wide or extended press nip 1 with the approximately cylindrical backing roll 8. The roll 8 may be sag controlled, i.e., the roll 8 may be comprised of a metallic roll shell 9 which is rotatable around a fixed support 10 and which is mounted on the support via several support elements 11. Alternatively, the roll 8 may be a normal roll which is not sag controlled, as shown in FIG. 3. In FIG. 3, it is also shown that the flexible roll shell 5 of the press roll 3 is selectively of uniform circumference along the axial direction or may have decreasing circumference axially outwardly, i.e., it may be crowned, as shown by dash-dot line 5*a*.

For forming as uniform as possible a press nip 15 between the backing roll 8 and the third roll 14, the outer circumference of the roll shell 9 of the backing roll 8 decreases in the axial direction, starting from the center of the roll toward the ends of the roll, i.e., the roll 8 is crowned, so that the sagging of the third roll 14 can be followed even in case of axially long roll widths. This is illustrated by FIG. 4. A bearing 17 inside the ends of the roll shell 9 supports the shell with respect to the support 10 about which the shell rotates.

To minimize the extent of the circumferential change and thus also to minimize the change in speed on the surface of the roll shell along the backing roll 8, the circumference of the shell of the third roll 14 also decreases axially toward the ends of the roll to the same extent as the backing roll 8, i.e., the roll 14 is crowned, again as seen in FIGS. 3 and 4. This avoids differences in speed on the surfaces of the roll shell between the backing roll 8 and the third roll 14, as these differences could negatively affect the result of the treatment of the web of material 2. For the same reason, the circumference of the roll shell 5 of the press roll 3 may be decreased, i.e., it too may be crowned, to the same extent axially toward the ends of the roll. The change in the roll circumference can be achieved via a change in the internal diameters of the roll shells 5, 9 and/or a change of the wall thicknesses of the roll shells 5, 9. It is however also possible in supplementary manner or by itself, to correspondingly act on the roll shells 5, 9 thermally from the inside, for instance, via the lubricating fluid of the support elements 6, 11 and/or from the outside, for instance by blowing hot air or inductively, and to bring about a circumference change in this manner. The same circumference change techniques and control over wall thicknesses apply for the third roll 14.

As an independent or, as in this case, supplemental measure, in FIG. 1, the action direction of the support elements 11 of the backing roll are in a plane that is inclined slightly, by an angle Δ, which is between 2 and 15, and preferably 4° and 80°, out of the press plane formed by the press roll 3 and the backing roll 8 and toward the third roll 14 which forms an additional press nip 15 with the backing roll 8. The roll shell 9 of the backing roll 8 is fixed in position on the support 10 at its ends by bearings. As a result, the deformation of the roll shell 9 of the backing roll 8, resulting from the inclination of the support elements 11, acts particularly strongly in the axial central region so that the roll shell 9 is deformed more strongly there toward the third roll 14. If the angle Δ decreases (and FIG. 1A shows that angle at 0° ), this effect becomes even more pronounced starting from the center of the roll, in the axial directions toward the ends of the roll. It may also be advantageous to make the angle Δ variable, for instance by a controllable rotatability of the support 10 of the backing roll 8, together with the corresponding support elements 11 to influence the degree of deformation of the roll shell 9 of the backing roll 8. Further, the angle may be varied over the axial length of the backing roll for controlling sag along the length. FIG. 5 shows support elements 11 that are not in one plane through the roll or at one angular location around the roll, but which vary in their angular position varying the angle Δ along the roll.

If the optional fourth roll 18 is provided, it is disposed below the third roll and the nip between those rolls is also out of the press plane through the nip 1.

In the embodiment of FIG. 1A, the support elements 6 of the press roll and 11 of the backing roll are in the press plane, and are not inclined out of the press plane by any angle as in the contrasting arrangement in FIG. 1.

The other significant distinction of FIG. 1A is that there is no optional fourth roll 18 and no bottom felt 16", so that the web is carried into the first nip 15, through which it passes, on the outside of the felt 16.

The hydraulic fluid supply to the support elements 6 and 11 of the press and backing rolls 3 and 8, respectively, is assured simply by using a common fluid pressure line 12, with one respective throttle 13 being located between the fluid pressure line 12 and each support element 11 of the backing roll 8, as in FIG. 4. FIG. 2 illustrates a respective group of support elements 11 which are supplied from the line 12 through each throttle 13. This assures that a greater pressing pressure is applied at the press roll 3 than at the backing roll so that the shell 9 of the backing roll 8, which shell is mounted at the ends of the roll, sags downward in its axial central region, i.e. toward the third roll 14. This also promotes the formation of a uniform second press nip 15. The greater pressing force of the press roll 3 with respect to the backing roll 8 can also be achieved via adjusting the relative sizes of the support surfaces 7 of the oppositely located support elements 6, 11 of both rolls.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A roll press for the treatment of a web of material, the press comprising at least three rolls forming several press nips, each nip between two of the rolls;

one of the rolls comprising a press roll comprising a very flexible first roll shell, a fixed support around which the first shell is rotatable, at least one support element mounted on the support, the support element having a concave support surface for defining a wide press nip;

a backing roll meeting the first roll shell at the support surface for defining the wide nip; the backing roll having a respective second rotatable roll shell;

the backing roll including a second fixed support around which the second roll shell is rotatable;

the second roll shell being mounted at its ends in non-displaceable manner with respect to the second support;

at least one second support element supporting the second roll shell on the second support;

at least one, third, not sag-controlled roll forming an additional press nip with the backing roll;

wherein the second support element is oriented so that the direction of action of the second support element is slightly inclined, by an angle Δ, out of the press plane formed with the press roll and toward the third roll forming an additional press nip with the backing roll such that the roll shell of the backing roll is axially increasingly bent in its axially central region toward the third roll.

2. The roll press of claim 1, wherein the angle Δ is between 2 and 15°.

3. The roll press of claim 1, wherein the angle Δ is between 4 and 8°.

4. The roll press of claim 1, wherein the angle Δ is changing, starting from the axial center of the second roll axially towards the ends of the roll.

5. The roll press of claim 1, wherein the circumference of the second roll shell of the backing roll does not change in the axial direction.

6. The roll press of claim 1, wherein the circumference of the second roll shell of the backing roll decreases in the axial direction.

7. The roll press of claim 1, further comprising a respective web dewatering felt passing through each of the press nips for moving through the nip along with the web, the felts being guided through the nips and the rolls being rotatable in respective directions that the web passes from the additional press nip and then through the wide nip.

8. The roll press of claim 1, further comprising a fourth press roll forming a third press nip with the third roll.

9. The roll press for claim 8, further comprising a respective web dewatering felt passing through each of the press nips for moving through the nip along with the web, wherein the felts comprise:

a first felt passing through the third nip;

a second felt also passing through the third nip and wrapping the additional roll and passing through the additional nip between the additional roll and the backing roll; and a third felt passing through the wide nip.

* * * * *